United States Patent [19]

Howell et al.

[11] Patent Number: 4,787,446

[45] Date of Patent: Nov. 29, 1988

[54] INFLATABLE PACKER AND FLUID FLOW CONTROL APPARATUS FOR WELLBORE OPERATIONS

[75] Inventors: Eddie P. Howell, McKinney; Lonnie J. Smith, Allen; Dennis R. Wood, Plano, all of Tex.

[73] Assignee: Atlantic Richfield Company, Los Angeles, Calif.

[21] Appl. No.: 45,093

[22] Filed: May 1, 1987

[51] Int. Cl.[4] ..... E21B 33/127

[52] U.S. Cl. ..... 166/66.4; 166/187; 277/34.6

[58] Field of Search ..... 166/187, 188, 66.4, 166/122, 126, 130, 142, 148, 149, 151; 277/34, 34.6

[56] References Cited

U.S. PATENT DOCUMENTS

| | | | |
|---|---|---|---|
| Re. 32,345 | 2/1987 | Wood | 166/151 |
| 2,781,852 | 2/1957 | Rumble | 166/187 |
| 2,812,697 | 11/1957 | Laval, Jr. | 166/187 |
| 2,859,828 | 11/1958 | Williams | 277/34.6 |
| 3,134,441 | 5/1964 | Barry et al. | 166/66.4 |
| 3,254,722 | 6/1966 | Chenoweth | 166/187 |
| 3,503,444 | 3/1970 | Owen | 166/66.4 |
| 4,570,705 | 2/1986 | Walling | 166/77 |
| 4,612,984 | 9/1986 | Crawford | 166/77 |
| 4,673,035 | 6/1987 | Gipson | 166/77 |

*Primary Examiner*—Jerome W. Massie
*Assistant Examiner*—Terry Lee Melius
*Attorney, Agent, or Firm*—Michael E. Martin

[57] ABSTRACT

Apparatus for interconnecting a tubing string with downhole tool and for controlling the flow of fluid into a wellbore through the tubing string comprising an elongated body member and a resiliently deformable sleeve disposed around the body member and radially deformable to form a seal against the wellbore wall to seal off a zone of interest. The body member includes a passage for extension of a wireline cable from the tubing string to the downhole tool. An electric motor operated rotary plug valve is disposed in the apparatus body and is operable to be rotated to valve pressure fluid from the tubing string into an expansible chamber to cause the seal sleeve to deform to seal the wellbore. The valve member is movable to positions to relieve pressure fluid from the seal, to valve pressure fluid to the wellbore at an injection point below the seal and to block all ports. A lower head member of the apparatus includes an anchor for the wireline cable sheath and an upper head member includes a check valve to prevent backflow of fluids from the wellbore into the tubing string.

15 Claims, 4 Drawing Sheets

INFLATABLE PACKER AND FLUID FLOW CONTROL APPARATUS FOR WELLBORE OPERATIONS

BACKGROUND OF THE INVENTION

1. Field of the Invention

The present invention pertains to an apparatus for interconnecting a tubing string with a downhole well tool and which includes an inflatable packer and a fluid flow control valve for controlling the flow of fluid to inflate the packer and for injection of fluids into the wellbore.

2. Background

The development of downhole well tools and instruments for determining the characteristics of subterranean formations has become an important process in producing hydrocarbons from subterranean reservoirs. Many operations require the deployment of electrically operated tools and instruments in the wellbore and hence an electrical multiconductor cable is required for the transmission of signals between the tool and a srrface control unit or data recording system, such cables sometimes referred to as "wirelines."

In certain types of operations involving dcwnhole electrical tools and instruments, it is advantageous and often necessary to convey such apparatus into and out of the wellbore connected to an elongated tubing string which may be of a type sometimes referred to as "coiled tubing." The wireline cable is typically run within the tubing string to the tool or instrument and the tubing string is utilized to inject certain fluids into a zone of interest penetrated by the wellbore.

With these types of operations in mind, there has been a need to provide an apparatus which is able to control the flow of fluids into and out of the wellbore, provide for sealing or packing off of the zone of interest to be injected with fluid or to be measured for pressure and fluid flow characteristics and which is adapted to be interposed between the tool and the tubing string. It is to this end that the present invention has been developed.

SUMMARY OF THE INVENTION

The present invention provides an apparatus for use in downhole wellbore operations for interconnecting a wireline operated tool or instrument with an elongated tubing string and whereby a wireline cable may be extended through the apparatus. The present invention also provides an apparatus which may be utilized to control the flow of fluid into a zone of interest and to seal off the zone of interest from other portions of the wellbore.

In accordance with an important aspect of the present invention, an apparatus is provided which includes an inflatable packer formed by a resiliently deformable boot or sleeve extending around an elongated mandrel or housing. The packer is adapted to be inflated or deflated by pressure fluid controlled from a remotely operated valve disposed in a housing on which the boot is mounted.

In accordance with another aspect of the present invention, an apparatus is provided for operating wireline tools and instrumentation in a wellbore which includes an inflatable packer, a path for extending a wireline cable through the apparatus between the tubing string and the tool and means for anchoring the cable.

In accordance with still another aspect of the present invention, there is provided a downhole apparatus for interconnecting a tubing string with a wireline tool which includes a one way valve to prevent the flow of wellbore fluids up the tubing string, but permits the flow of fluids from the tubing string through the apparatus and into the wellbore. The apparatus includes a motor operated valve for directing the flow of fluid to inflate a packer or seal boot to seal off the wellbore at the location of the apparatus itself, to provide for injection of fluids from the tubing string into the wellbore through the apparatus, to deflate or retract the packer seal or to block the flow of fluids through the apparatus.

Those skilled in the art will recognize the above described features and advantages of the present invention as well as other superior aspects thereof upon reading the detailed description which follows in conjunction with the drawing.

DESCRIPTION OF A PREFERRED EMBODIMENT

Figure 1:
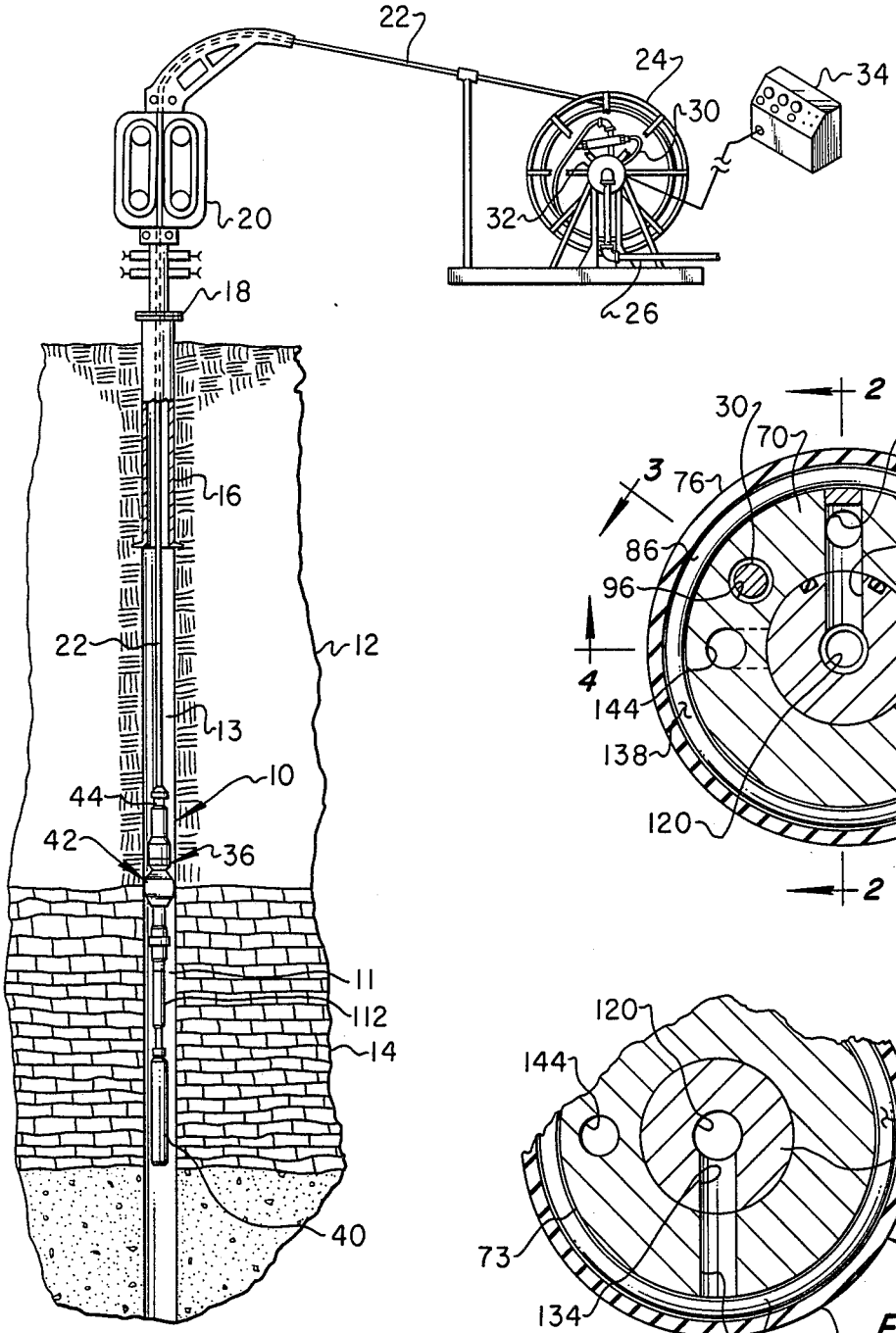
FIG. 1 is a schematic diagram showing the apparatus of the present invention disposed in a wellbore and connected to an elongated coilable tube for insertion and withdrawal of the apparatus.

In the description which follows, like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated a wellbore 10 which is penetrating an earth formation 12 which includes a zone of interest 14. The wellbore 10, at the portion which penetrates the zone 14, may be in a so-called open hole condition or may be lined with a metal casing in accordance with conventional well completion practices. At least an upper portion of the wellbore 10 includes a casing 16 which extends to a wellhead 18 on which is mounted an injection apparatus 20 for injecting an elongated metal tubing string 22 into and out of the wellbore. The tubing string 22 is preferably stored on a rotatable reel 24 which includes suitable means connected to one end of the tubing string for injecting fluids by way of a conduit 26. The tubing string is adapted to have an elongated electrical cable extending therethrough and which will be shown and described in further detail herein. The cable extends from the upper end of the tubing string 22, as indicated at 30 in FIG. 1, and is connected to a suitable slipring assembly 32 for interconnection with an instrument console 34. Further details illustrating the manner in which the cable 30 is terminated at the reel 24 are described in U.S. Pat. No. 4,685,516 issued to Lonnie Joe Smith et al and assigned to the assignee of the present invention.

Referring further to FIG. 1, the tubing string 22 terminates at its end disposed in the wellbore 10 in an apparatus, generally designated by the numeral 36, to be described in further detail herein, which is adapted to interconnect the tubing string with a downhole tool 40. The tool 40 may be a formation survey or logging tool, a perforating tool or other type of apparatus for performing wellbore operations. In certain operations, it is desirable to seal off the wellbore 10 in the region 11, for example, so that certain operations may be performed in relation to the formation zone of interest 14. In this respect, the apparatus 36 includes resilient seal means 42 to be described in further detail herein engageable with the walls of the wellbore 10 to seal the region or wellbore portion 11 from the portion 13 above the seal means 42. The seal means 42 is also sometimes referred to as a "packer" or "inflatable packer" and, in combination with the other structure of the apparatus 36 provides a unique apparatus which will now be described in further detail with reference to FIGS. 2 through 7.

Figure 2:
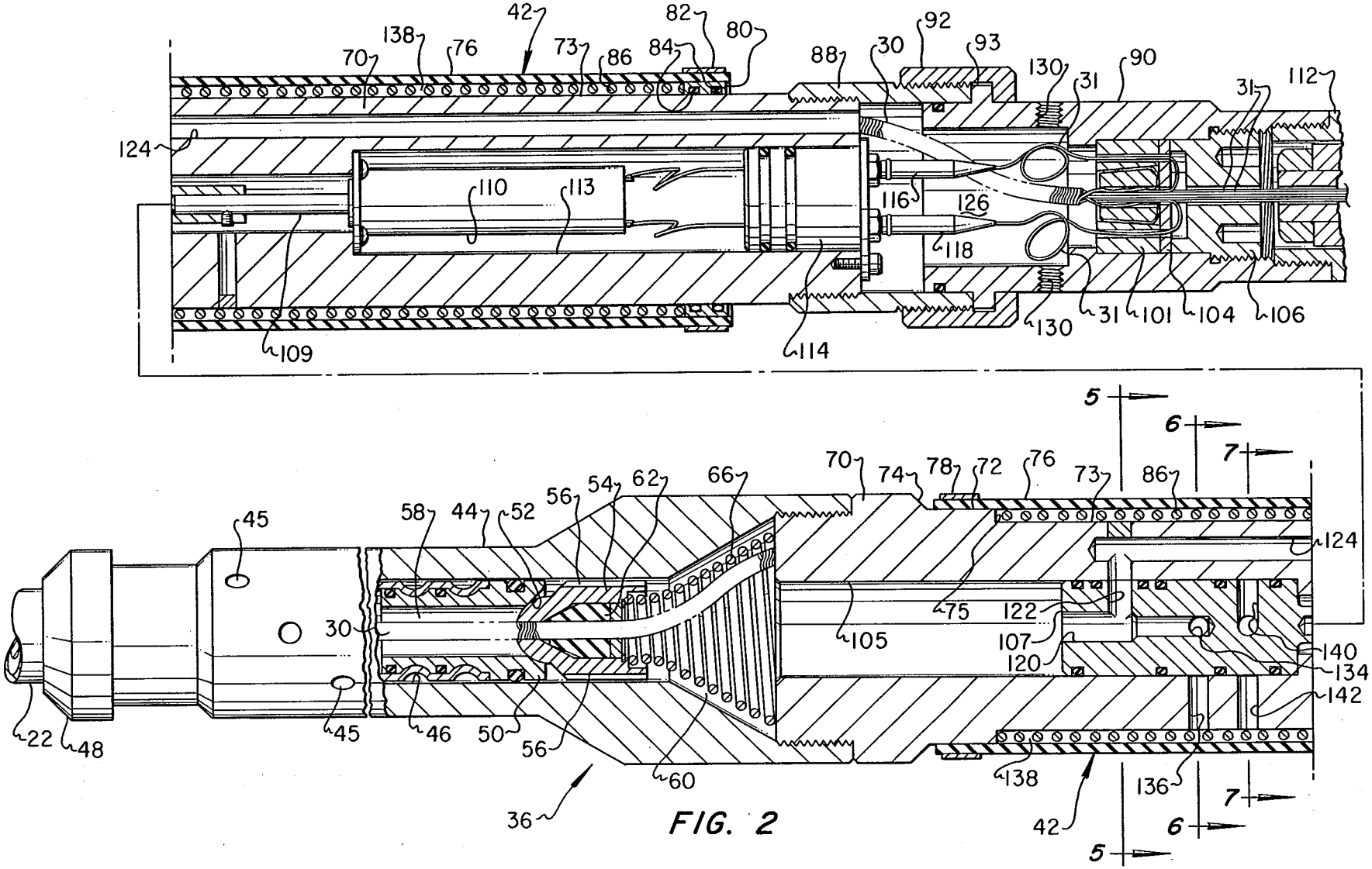
FIG. 2 is a longitudinal central section view taken along the line 2—2 of FIG. 5.

Referring primarily to FIG. 2, the apparatus 36 includes a generally tubular upper head portion 44 having an elongated bore 46 extending therethrough for receiving the lower distal end of the tubing string 22. The head portion 44 preferably includes a so-called fishing neck 48 at the upper distal end thereof for engagement with a fishing or retrieval tool, not shown, in the event of unwanted separation of the tubing string 22 from the apparatus 36. The tubing string 22 may be secured to the head portion 44 by a plurality of radially projecting retaining screws 45. The distal end of the tubing string 22 is secured to a valve seat member 50 having a generally frustoconical shaped valve seating surface 52 formed thereon for engagement by a check valve closure member 54. The closure member 54 is slidably disposed in the bore 46 and includes a plurality of grooves 56 forming flow passages between an interior flow passage 58 and an enlarged chamber 60 formed in the head portion 44. The closure member 54 is provided with a resilient elastomeric insert 62 through which extends the wireline cable 30 in sealing engagement therewith to prevent flow of fluids between the passage 58 and the chamber 60 when the closure member is seated against the seating surface 52. The closure member 54 is biased into its closed position by a conical coil spring 66. The check valve 54 is described in further detail in U.S. patent application Ser. No. 18,683 filed: Feb. 25, 1987 in the name of Lonnie Joe Smith, et al and assigned to the assignee of the present invention.

The head portion 44 is threadedly connected to a generally cylindrical elongated body member 70. The body member 70 has a generally cylindrical outer surface 72 which extends from a shoulder 74 to which is clamped at one end an elongated resilient boot or sleeve member 76. The sleeve member 76, comprising the seal means 42, is secured to the surface 72 by a suitable band type clamp 78 and extends over a substantial portion of the body member 70 in spaced relationship to a surface portion 73 and is secured at its opposite end to a slidable piston 80. The piston 80 is of an annular configuration and is secured to the sleeve member 76 by a band type clamp 82 and is slidably but sealingly engaged with the surface 73 by suitable seal members 84. A coil spring 86 extends between the piston 80 and a transverse shoulder 75 for biasing the sleeve member 76 in a longitudinally extended and radially retracted position. The body member 70 is threadedly connected at its opposite end to a removable extension part 88 which is secured to an opposite head member 90 by a nut 92 which engages an annular shoulder 93 formed on the head member 90.

Figure 3:
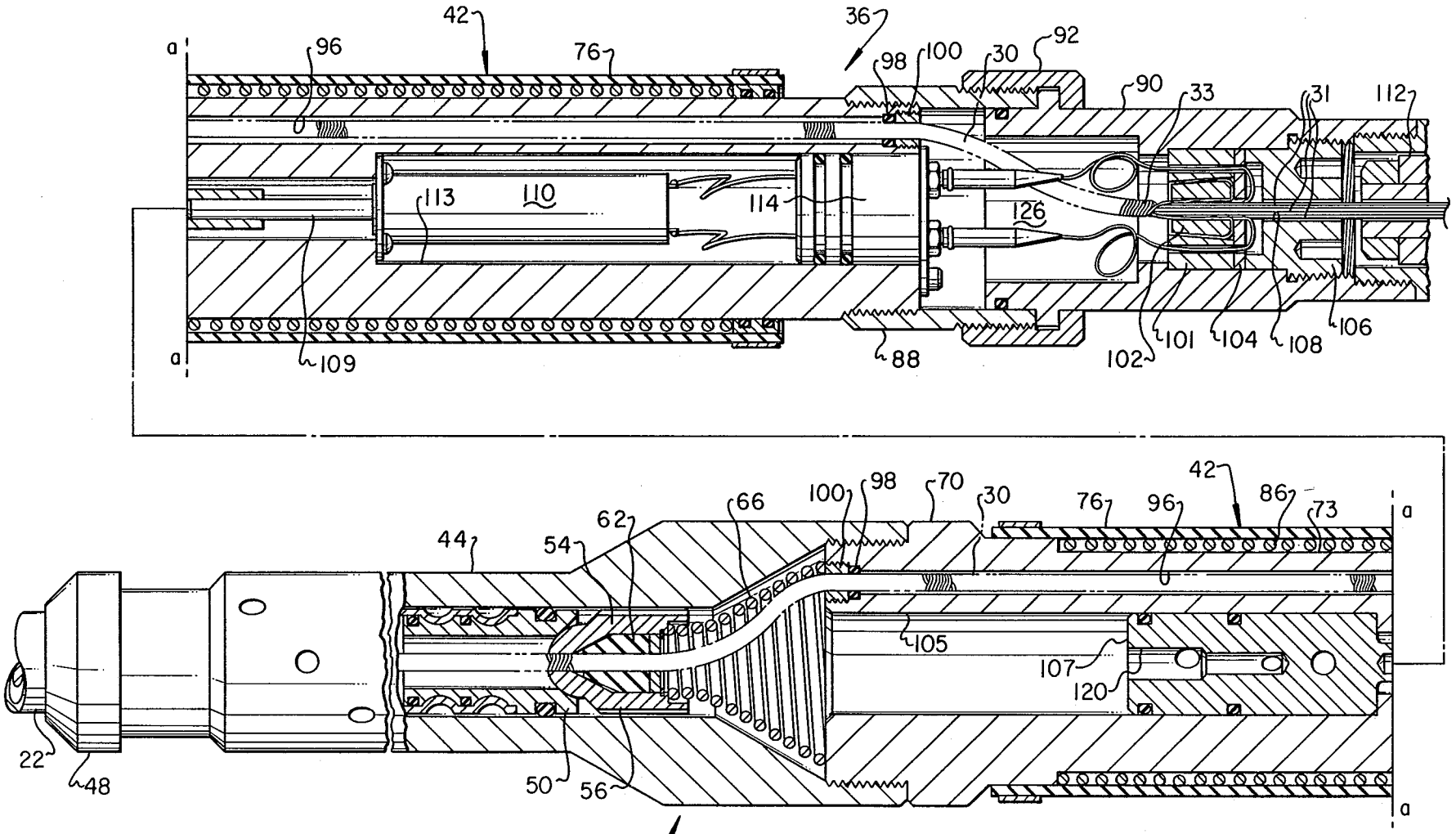
FIG. 3 is a longitudinal section view taken along the line 3—3 of FIG. 5.

Referring briefly to FIG. 3, the wireline cable 30 extends through the insert 62, an elongated passage 96 formed in the body member 70 and through the interior of the head member 90. The passage 96 is sealed at its opposite ends to prevent the flow of fluids therethrough by suitable, deformable seal members 98 which are engageable by seal compression nuts 100, respectively. The wireline cable 30 is of a type which is typically provided with a braided metal outer sheath which forms a structural load bearing member to relieve conductors 31 of the requirement of withstanding longitudinal pulling forces on the cable. The outer sheath is generally designated by the numeral 33 and is anchored in the head portion 90 by a frustoconical bushing 101 which receives a generally cone shaped retainer member 102. The retainer member 102 is retained in the bushing 101 by a washer 104 and a nut 106 having a bore 108 through which the conductors 31 extend to a suitable connector body 112, see FIG. 1 also. The connector body 112 extends between the apparatus 36 and the tool 40 and may comprise a frangible coupling of a type such as disclosed in U.S. Pat. No. 4,706,744 and assigned to the assignee of the present invention.

Referring again to FIG. 2, the apparatus 36 includes means for controlling the flow of fluid from the tubing string 22 for actuating the resilient seal means 42, characterized by the sleeve 76, for injection of fluid into the wellbore portion 11 and for releasing the seal means 42 from engagement with the wellbore wall. The body member 70 includes an elongated bore 105 forming a passage in communication with the chamber 60 for receiving fluid pumped through the tubing string 22. A rotary plug type valve closure member 107 is rotatably disposed in the bore 105 and includes a hub portion connected to the output shaft 109 of a rotary motor 110. The motor 110 is disposed in a second bore 113 extending from the opposite end of the body member and which is closed by a suitable plug 114 including electrial conductor connector members 116 and 118. The connectors 116 and 118 are connected to respective ones of two of the conductors 31 of the wireline cable 30 for operably driving the motor lI0. The motor 110 may be a rotary stepping motor adapted to rotate in 90° increments to rotate the valve closure plug 107 as required to accomplish the fluid flow control functions of the apparatus 36.

As shown in FIG. 2, the closure member 107 includes a central passage 120 opening into the bore 105 and a first radially extending passage 122 opening into, in the position illustrated in FIG. 2, a longitudinal passage 124 extending through the body member 70 and opening into a space 126 formed by the extension member 88 and the head member 90. A plurality of ports 130 open into the space 126 for conducting fluid into the wellbore annulus below the seal means 42. The terms "above" and "below" or "upper" and "lower" are used for convenience only in this description. Thus, in the position of the closure member 107 illustrated in FIG. 2 pressure fluid may be conducted from the tubing string 22 into the wellbore by way of the chamber 60, bore 105 and passages 120, 122, 124 and 126.

Fluid pumped through the tubing string 22 may be used to activate the seal means 42 through operation of the valve closure member 107. Referring to FIGS. 2 and 6, the passage 120 in the closure member 107 is in communication with a second radial passage 134 which, in the rotative position of the closure member 107 shown in FIG. 6, communicates with a passage 136 opening into a chamber 138 formed between the sleeve 76 and the surface 73. FIG. 6 shows the closure member 107 rotated 270° clockwise, viewing FIGS. 5 or 6, from the position shown in FIG. 2. Pressure fluid may be admitted to the chamber 138 to radially outwardly deflect the sleeve 76 into sealing engagement with the wall of the wellbore. Radial outward deflection of the sleeve moves the piston 80 toward the shoulder 74 against the bias of the coil spring 86.

Figure 7:
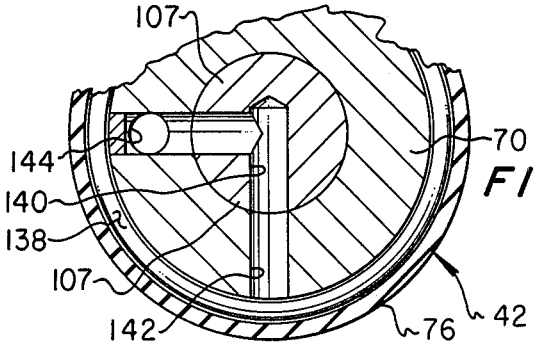
FIG. 7 is a detail section view taken along the line 7—7 of FIG. 2.
Figure 4:
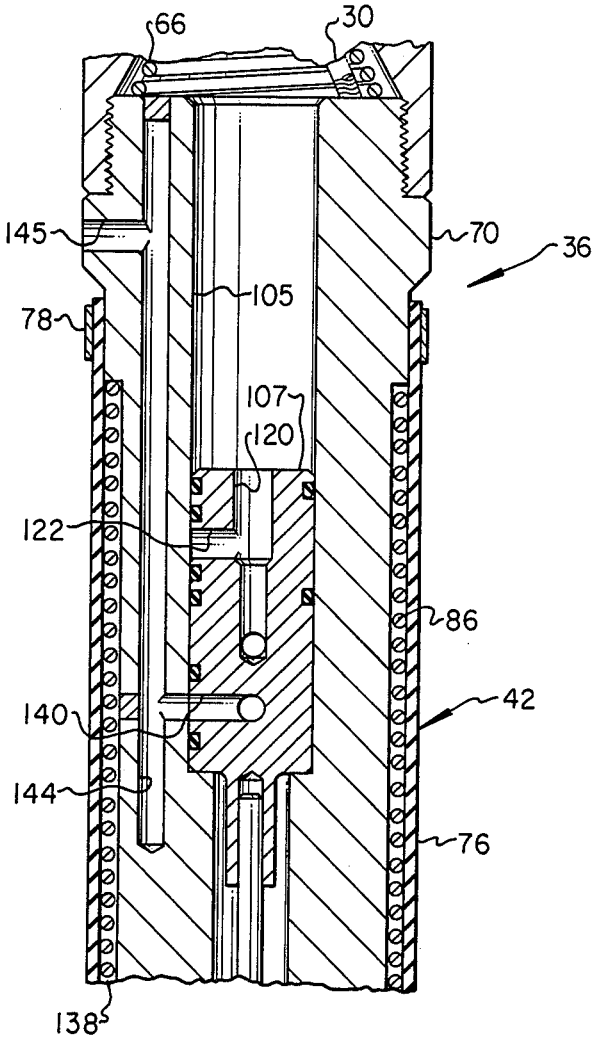
FIG. 4 is a detail section view taken along the line 4—4 of FIG. 5.

When it is desired to retract the sleeve 76 back to the position illustrated in FIG. 2, the closure member 107 may be rotated to the position of FIG. 4 and FIG. 7, which is through an arc of 180° clockwise from the position of FIG. 2, wherein a right angle passage 140 member communicates the space 138 with the exterior of the apparatus 36 above the seal means 42 by way of a passage 142. Passage 142 opens into the chamber 138, FIG. 7, and is operable to communicate with a passage 144, see FIG. 4, which opens to the exterior of the body member 70 at a port 145.

Figure 5:
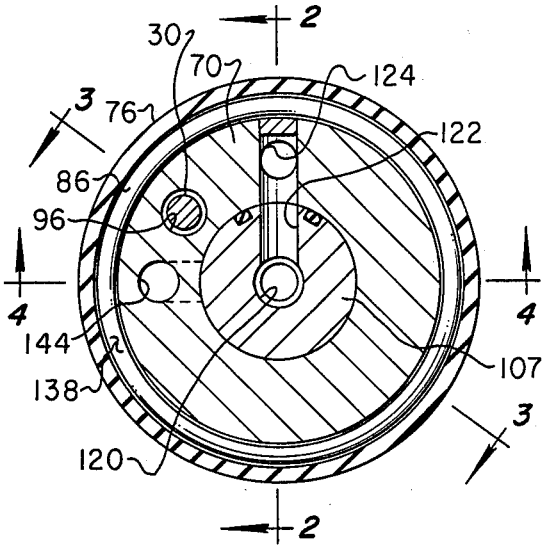
FIG. 5 is a detail section view taken along the line 5—5 of FIG. 2.
Figure 6:
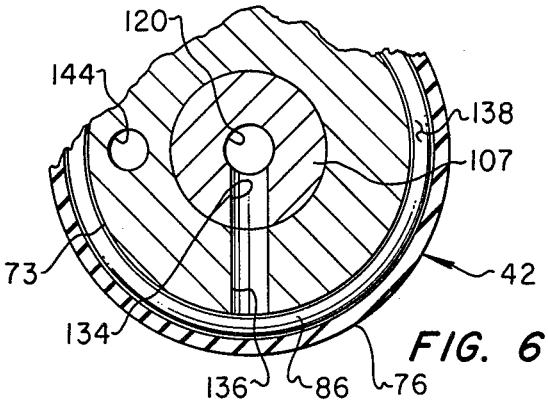
FIG. 6 is a detail section view taken alcng the line 6—6 of FIG. 2.

The passages 122, 134 and 140 are oriented relative to each other such that in the position of FIG. 5 the valve closure member 107 is operable to conduct pressure fluid to the passage 124 for injection of fluid into the wellbore, preferably after pressurizing the chamber 138 to resiliently deform the sleeve 76 into sealing engagement with the wellbore wall. If the closure member 107 is rotated 90° in a clockwise direction, viewing FIG. 5 from the position shown in FIG. 5, all of the passages 122, 134 and 142 are blocked from communicating pressure fluid. If the closure member 107 is rotated another 90° to the position illustrated in FIG. 7, the chamber 138 is placed in communication with the exterior of the apparatus 36 by way of the passages 142, 140 and 144 and port 145. Still further, if the closure member 107 is rotated to the position shown in FIG. 6, which is 270° clockwise from the FIG. 5 position, fluid is communicated from the passage 104 to the chamber 138 through the passages 134 and 136.

Accordingly, by rotatably positioning the valve closure member 107, the seal means 42 may be activated and deactiviated and the control of the flow of fluids from the tubing string 22 into the wellbore region 11 may be obtained. Various wellbore operations may be carried out including the injection of liquids and gases into a formation zone of interest which is sealed off from that portion of the we11bore above the seal means 42, viewing FIG. 1. Those skilled in the art will recognize that the body member 70 and the closure member 107 may be modified to include passages for injecting fluid into the wellbore at a point above the seal means 42 and the motor 110 modified or controlled to perform other sequences of operation of the closure member, if desired. The check valve closure member 52 prevents the reverse flow of fluids from the wellbore into and up through the tubing string 22. The apparatus 36 thus provides means for sealing off a portion of a wellbore and then, if desired, conducting pressure fluids into the sealed off portion of the wellbore while also providing for extension of a wireline cable and its associated electrical conductors through the apparatus and to additional apparatus or tool means disposed in the wellbore and connected to the tubing string through the apparatus 36.

The apparatus 36 may be constructed using conventional engineering materials used for downhole well tools. The assembly, disassembly and operation of the apparatus 36 is believed to be within the purview of one of ordinary skill in the art based on the foregoing description. Although a preferred embodiment of the present invention has been described in detail herein, those skilled in the art will reconize that various substitutions and modifications may be made to the embodiment described without departing from the scope and spirit of the invention as recited in the appended claims.

What is claimed is:

1. Apparatus for insertion into a wellbore and connected to an elongated tubing string extending from the earth's surface into said wellbore, said apparatus being connected to electrical cable means extending through said tubing string, said apparatus being adapted to be disposed between said tubing string and a downhole tool operably controlled by said cable means and for controlling the flow of pressure fluid between said tubing string and said wellbore, said apparatus including:

a body including means for connecting said apparatus to said tubing string and to said downhole tool, said body including passage means therein for extending said cable means through said apparatus to said downhole tool;

resilient seal means disposed on said body and operable to be actuated by pressure fluid to engage a wall of said wellbore to form a fluid seal in said wellbore between said tubing string and said downhole tool;

passage means in said body for conducting pressure fluid between said tubing string and said seal means;

passage means in said body for conducting pressure fluid between said tubing string and said wellbore; and motor operated valve means disposed on said apparatus for selectively controlling the flow of pressure fluid from said tubing string to operate said seal means and to inject pressure fluid into said wellbore.

2. The apparatus set forth in claim 1 wherein:

said body includes an elongated body member having a generally cylindrical outer surface, said seal means includes a flexible sleeve disposed around at least a portion of said surface and secured to said body member to form an expansible chamber, passage means in said body member communicating said expansible chamber with said valve means and passage means in said body member communicating said valve means with the exterior of said apparatus, and said valve means is operable to valve pressure fluid to said expansible chamber to effect actuation of said sleeve to engage a wall of said wellbore to form a substantially fluid tight seal and to place said expansible chamber in communication with said wellbore to vent pressure fluid from said expansible chamber.

3. The apparatus set forth in claim 3 including:

piston means formed at one end of said sleeve and slidably disposed around said surface for movement therealong in response to valving pressure fluid to said expansible chamber to radially extend said sleeve into engagement with a wall of said wellbore.

4. The apparatus set forth in claim 3 including:
spring means disposed on said apparatus and operably engaged with said sleeve for effecting movement of said sleeve away from said wall of said wellbore in response to venting of pressure fluid from said expansible chamber.

5. The apparatus set forth in claim 4 wherein:
said spring means comprises a coil spring disposed in said expansible chamber and engaged with said piston means.

6. The apparatus set forth in claim 1 wherein:
said seal means includes means defining an expansible chamber and said valve means includes a closure member for communicating pressure fluid between said tubing string and said expansible chamber in a first position and communicating said expansible chamber with the exterior of said tool between said seal means and said tubing string in a second position.

7. The apparatus set forth in claim 6 wherein:
said closure member includes passage means formed therein for conducting pressure fluid from said tubing string to said wellbore in a third position, said closure member being configured to provide for movement to a fourth position to block the flow of pressure fluid through said apparatus by way of said valve means.

8. The apparatus set forth in claim 7 wherein:
said closure member comprises a rotary plug member disposed in a bore formed in said body.

9. The apparatus set forth in claim 8 including:
electric motor means disposed in said body and operably connected to said plug member for rotating said plug member to said first, second, third and fourth positions, respectively.

10. The apparatus set forth in claim 1 including:
a one way valve interposed between said tubing string and said valve means and operable to prevent the flow of wellbore fluid into said tubing string, said one way valve including means for extending said cable means therethrough.

11. The apparatus set forth in claim 1 wherein:
said body includes an upper head portion, an elongated central body member and a lower head portion, said upper and lower head portions being releasably connected to said body member.

12. The apparatus set forth in claim 1 including:
anchor means disposed in said body for anchoring said cable means in said apparatus, said anchor means including a member having a conical bore, a conical plug insertable in said bore for forcibly engaging a plurality of filaments comprising a load bearing portion of said cable means, and means for retaining said plug in said bore.

13. Apparatus for insertion into a wellbore and connected to an elongated tubing string extending within said wellbore, said apparatus being disposed between said tubing string and a downhole tool, said apparatus including:
a body including means for connecting said apparatus to said tubing string and to said downhole tool, said body including means for connecting electrical cable means to said apparatus;
resilient seal means disposed on said body and operable to be actuated to engage a wall of said wellbore to form a seal in said wellbore between said tubing string and said downhole tool, said seal means including means forming a chamber and being responsive to flow of pressure fluid to said chamber to be extended to form said seal and responsive to venting pressure fluid from said chamber to retract from sealing engagement with said wellbore;
passage means in said body for conducting pressure fluid from said tubing string to said wellbore in an area of said wellbore including said tool;
passage means in said body for conducting pressure fluid from said tubing string to said chamber;
passage means in said body for conducting pressure fluid from said chamber to said wellbore; and
motor operated valve means disposed on said apparatus for controlling the flow of pressure fluid to and from said chamber to operate said seal means and from said tubing string to inject pressure fluid into said wellbore.

14. The apparatus set forth in claim 13 including:
one way valve means interposed between said tubing string and said motor operated valve means and operable to prevent the flow of wellbore fluid into said tubing string from said passage means.

15. The apparatus set forth in claim 13 wherein:
said passage means for conducting pressure fluid from said chamber to said wellbore opens from said body into said wellbore between said seal means and said tubing string.

* * * * *

UNITED STATES PATENT AND TRADEMARK OFFICE

CERTIFICATE OF CORRECTION

PATENT NO. : 4,787,446

DATED : Nov. 29, 1988

INVENTOR(S) : Eddie P. Howell, Lonnie J. Smith and Dennis R. Wood

It is certified that error appears in the above-identified patent and that said Letters Patent is hereby corrected as shown below:

Column 6, line 62, delete "3" (second occurrence) and insert --- 2 ---.

Signed and Sealed this

First Day of August, 1989

*Attest:*

*Attesting Officer*

DONALD J. QUIGG

*Commissioner of Patents and Trademarks*